US006877739B2

(12) United States Patent
Leitz et al.

(10) Patent No.: US 6,877,739 B2
(45) Date of Patent: Apr. 12, 2005

(54) VERTICAL STACKER INPUT METHOD AND APPARATUS

(75) Inventors: Jerry Leitz, New Milford, CT (US); Donald A. Ross, New Milford, CT (US); Paul Snopkowski, Southbury, CT (US); John W. Sussmeier, Cold Spring, NY (US)

(73) Assignee: Pitney Bowes Inc., Stamford, CT (US)

( * ) Notice: Subject to any disclaimer, the term of this patent is extended or adjusted under 35 U.S.C. 154(b) by 270 days.

(21) Appl. No.: 10/320,167

(22) Filed: Dec. 16, 2002

(65) Prior Publication Data

US 2004/0113354 A1 Jun. 17, 2004

(51) Int. Cl.[7] ..... B65H 31/06

(52) U.S. Cl. ..... 271/178; 271/181; 271/215; 271/207

(58) Field of Search ..... 271/178, 181, 271/180, 177, 207, 213, 214, 215

(56) References Cited

U.S. PATENT DOCUMENTS 582,593 A * 5/1897 Waite ..... 271/178
3,342,481 A * 9/1967 Kaplan ..... 271/178
4,169,341 A * 10/1979 Roetter et al. ..... 53/154
4,524,965 A 6/1985 Kulpa
4,570,922 A * 2/1986 Akers ..... 271/178
4,940,219 A * 7/1990 Volat ..... 271/2
5,429,249 A 7/1995 Belec et al.
6,398,204 B1 * 6/2002 Keane et al. ..... 271/2
6,540,223 B2 * 4/2003 Keane et al. ..... 271/178
6,634,639 B2 * 10/2003 Kuroda et al. ..... 271/178
6,682,067 B1 * 1/2004 Keane et al. ..... 271/224

* cited by examiner

*Primary Examiner*—Patrick Mackey
(74) *Attorney, Agent, or Firm*—Michael J. Cummings; Charles R. Malandra, Jr.; Angelo N. Chaclas

(57) ABSTRACT

An on-edge stacking machine having a mailpiece input device to release mailpieces, one at a time, to a stacking deck for stacking. A speed monitoring device and a sensing device are used to monitor the moving speed and the arrival time of a mailpiece from the input device to a reference point of the stacking machine. Based on the moving speed and the arrival time, a displacement distance of the arriving mailpiece is computed. A segmented roller is then used to move the arriving mailpiece into the bottom of the stack in a two-part motion cycle, based on the displacement of the arriving mailpiece.

10 Claims, 15 Drawing Sheets

VERTICAL STACKER INPUT METHOD AND APPARATUS

TECHNICAL FIELD

The present invention relates generally to a mail stacking machine and, more particularly, to a vertical, or on-edge, stacker using a segmented roller to move an input mailpiece into the bottom of a mail stack.

BACKGROUND OF THE INVENTION

A mass mailing system generally comprises a mail inserting machine and a mail stacking machine. The mail inserting machine includes an envelope feeder and an enclosure document supply section. The envelope feeder is used to feed envelopes, one at a time, to an envelope insertion station. In the enclosure document supply section, a plurality of enclosure feeders is used to release enclosure documents to a chassis. The released documents are then gathered, collated and pushed by a plurality of pusher fingers to the envelope insertion station for insertion. Mail inserting machines are known in the art. For example, Roetter et al. (U.S. Pat. No. 4,169,341) discloses a mail inserting machine wherein documents are released onto a continuous conveyor mechanism to be collected and collated in a continuous matter. After the enclosure documents are inserted into the envelopes, the filled envelopes are typically transported to another piece of equipment that seals the envelopes and affixes postage or prints a postage indicium on each envelope.

The filled envelopes are typically collected and loaded by an operator into mail trays or other forms of storage. This step in the mass mailing process has been found to be a "bottleneck". One way to assist the operator in eliminating the bottleneck is to use an envelope stacking machine to automatically collect the filled envelopes into a stack so that the operator can remove the filled envelopes in stacks. One of the commonly used envelope stackers is an on-edge stacking apparatus. For example, Keane et al. (U.S. Pat. No. 6,398,204) discloses a mail stacking machine where a belt turn-up unit is used to turn the filled envelope from a horizontally facing direction to a vertical or "on-edge" position. The vertically oriented envelope is driven by a segmented roller into the bottom of a vertical stack.

A typical stacking machine 1, as shown in FIG. 1, comprises a mailpiece input device 30, an incoming mailpiece moving device 40 and a stacking deck 50 having a first side 56 and a second side 58. As shown in FIG. 1, the stacking deck 50 has a deck surface 52 to support a stack of mailpieces 20. An incoming mailpiece 10, which enters the stack deck 50 from the input device 30 along a direction 110, is driven by the moving device 40 into the bottom of the stack 20. As more mailpieces 10 are added to the bottom end 24 of the stack 20, the stack 20 expands or grows toward the downstream end of the stacking deck 50. As the stack 20 expands, the pressure on the incoming envelope 10 increases. In order to relieve the stack pressure, a continuous conveyor belt 54 moving along a direction 120 is used to space out the stacked mailpieces, thereby making room for the next incoming mailpiece 10 to join the stack 20. At the same time, a paddle 60 is used to support the front end 22 of the stack 20, preventing the top mailpieces of the stack 20 from falling toward the downstream end. The paddle 60 is linked to a bearing collar 64 by a handle 62. The collar 64 is movably mounted over a shaft or support rod 66 for movement. The support rod 66, which is substantially parallel to the moving direction 120, is fixedly mounted on rod mounts 68.

As shown in FIG. 2, the mailpiece input device 30 has an input end and an output end. If the mailpiece 10 enters the input end of the mailpiece input device 30 in a horizontal orientation, it is possible to use a belt turn-up mechanism to change the orientation of the mailpiece 10 when it emerges from the output end. As shown, the belt turn-up mechanism comprises two inner rollers 34 and two exit rollers 36. The input rollers 34 and the exit rollers 36 are linked together with two continuous belts 32, 33 to form an input nip 134 at the input end and an exit nip 136 at the output end. The input nip 134 formed by the input rollers 34 and the belts 32, 33 receives a flat mailpiece 10 oriented in a generally horizontal direction. The exit nip 136 formed by the output rollers 36 and the belts 32, 33 drives the mailpiece 10 out of the input device 30 in a generally vertical direction so that the mailpiece 10 can be stacked in an on-edge stacker. As shown, the rollers 34, 36 are operatively connected to a motor 80 to move the belts 32, 33. A belt turn-up mechanism is known in the art (see Keane et al.).

In the on-edge stacker as disclosed in Keane et al., the incoming mailpiece moving device 40 comprises a segmented roller 42 and an intake roller 44 to move an incoming mailpiece 10 into the stack 20. As shown, the moving device 40 has a registration wall 48 to stop the leading edge of the incoming mailpiece 10 in order to align the incoming mailpiece 10 with other mailpieces in the stack 20. As shown in FIG. 3*a*, the segmented roller 42 has a flat, planar surface segment 142 and a curved or cylindrical surface segment 144. The planar surface segment 142 can be viewed as a cutoff segment of a cylinder. These segments meet with each other and form two edges: an inner edge 148 and an outer edge 146. When the segmented roller 42 is at rest at its home position, the inner edge 148 of the segmented roller 42 pushes the bottom end 24 of the mail stack 20 frontward to make room for the next mailpiece 10 to join the stack 20. As such, the incoming piece 10 can be driven by the rollers 36 along the direction 110 into the gap between the bottom of the mail stack 20 and an input guide 46. The planar surface segment 142 is typically a smooth, lubricous plastic surface so as not to hinder the movement of the incoming mailpiece 10. When the mailpiece 10 enters into the "throat" 242 formed by the flat surface segment 142 of the segmented roller 42 and the bottom of the mail stack 20, as shown in FIG. 3*b*, the segmented roller 42 is caused to rotate in a clockwise direction 150 in a continuous, one-part motion to drive the incoming mailpiece 10 toward the intake roller 44. The segmented roller 42 continues to drive the incoming mailpiece 10, as shown in FIGS. 3*c* and 3*d*, until the leading edge of the mailpiece 10 registers with the registration wall 48. The segmented roller 42 continues to rotate until it reaches its home position, as shown in FIG. 3*a*. For driving purposes, the cylindrical surface segment 144 of the segmented roller 42 typically has a highly frictional, elastomeric covering over the circumference.

This one-part movement of the segmented roller 42 may not work satisfactorily at high processing speeds, partly due to the variation in the arrival time of the incoming mailpiece 10. For example, when the motor 80 is cold, it has a lower speed than its average speed. Consequently, the segmented roller 42 may rotate before the incoming mailpiece 10 reaches a desired position in the gap between the exit nip 134 and the throat formed by the planar surface segment 142 of the segmented roller 42 and the bottom of the mail stack 20. Furthermore, if the segmented roller 42 is late in starting its motion cycle, the incoming mailpiece 10 may lose its momentum as it reaches the end of the throat.

Thus, it is advantageous and desirable to provide a method and device in an on-edge stacker to improve the performance thereof.

SUMMARY OF THE INVENTION

It is a primary objective of the present invention to provide a method and system for stacking a plurality of mailpieces into a stack, wherein a segmented roller is used to move an incoming mailpiece into the bottom of the stack in a consistent manner. This objective can be achieved by coordinating the rotation of the segmented roller according to a two-part motion profile based on the displacement of the incoming mailpiece in relation to a reference point.

Thus, according to the first aspect of the present invention, there is provided a stacking machine for stacking a plurality of mailpieces into a stack. The stacking machine comprises:

a stacking deck having an upstream end, a downstream end, a first side, an opposing second side, and a deck surface to support the stack, the stack having a first end and a second end adjacent to the upstream end;

a mail input device having a driving mechanism for releasing each of the mailpieces at a driving speed into the stacking deck from the first side toward the second side; and a segmented roller having a curved surface section and a cutoff section forming a first edge and a second edge, the first edge adjacent to the first side of the stacking deck and the second edge adjacent to the second side of the stacking deck when the cutoff section is facing the stack, wherein the segmented roller has a home position and is adapted to rotate in a motion cycle in a rotational direction to further move the released mailpiece toward the second side, and wherein when the segmented roller is located in the home position, the second edge is positioned closer than the first edge to the downstream end in order to prevent the mailpieces in the second end of the stack from moving backward toward the upstream end, and each motion cycle comprises a first start-and-stop motion segment and a second start-and-stop motion segment, wherein in the first start-and-stop motion segment, the segmented roller is caused to rotate in the rotational direction from the home position to a temporary position such that the second edge is moved away from the second end of the stack and both the first and second edges are disengaged from the second end of the stack, thereby forming a channel between the cutoff section and the second end of the stack to allow said each mailpiece to enter into the channel, and in the second start-and-stop motion segment, the segmented roller is caused to further rotate in the rotational direction away from the temporary position to the home position so as to allow the curved surface to drive the entered mailpiece into the second end of the stack.

Preferably, the stacking machine further comprises:

a sensing device, disposed between the mailpiece input device and the segmented roller, for sensing the arrival of said each mailpiece at a reference point in the stacking deck; and a speed monitoring device for monitoring the driving speed of the mail input device so as to control the motion cycle based on the arrival of said each mailpiece at the reference point and the driving speed of the mailpiece input device when said each mailpiece is released into the stacking deck.

Preferably, the second start-and-stop motion segment is started when the entered mailpiece has been displaced by a pre-determined distance from the reference point, and wherein the arrival of said each mailpiece at the reference point and the driving speed of the mailpiece input device when said each mailpiece is released into the stacking deck are used to determine when the entered mailpiece has been displaced by the pre-determined distance.

Preferably, the speed monitoring device is operatively connected to the driving mechanism of the mailpiece input device for said speed monitoring.

Preferably, the driving mechanism comprises a motor having a rear shaft, and the speed monitoring device is an optical encoder mounted on the rear shaft.

Preferably, the start of the first start-and-stop motion segment is also based on the arrival of said each mailpiece at the reference point.

According to the second aspect of the present invention, there is provided a method of stacking a plurality of mailpieces into a stack, wherein the stacking machine comprises:

a stacking deck having an upstream end, a downstream end, a first side, an opposing second side, and a deck surface to support the stack, the stack having a first end and a second end adjacent to the upstream end;

a mailpiece input device having a driving mechanism for releasing each of the mailpieces at a driving speed, into the stacking deck from the first side toward the second side; and a segmented roller having a curved surface section and a cutoff section forming a first edge and a second edge, the first edge adjacent to the first side of the stacking deck and the second edge adjacent to the second side of the stacking deck when the cutoff section is facing the second end of the stack, and wherein the segmented roller has a home position and is adapted to rotate in a motion cycle in a rotational direction to further move the released mailpiece toward the second side, and wherein when the segmented roller is located in the home position, the second edge is positioned closer than the first edge to the downstream end in order to prevent the mailpieces in the second end of the stack from moving backward toward the upstream end. The method comprises the steps of:

rotating the segmented roller from the home position to a temporary position in the rotational direction in a first start-and-stop motion segment of the motion cycle such that the second edge is moved away from the second end of the stack and both the first and second edges are disengaged from the second end of the stack, thereby forming a channel between the cutoff section and the second end of the stack to allow said each mailpiece to enter into the channel, and rotating the segmented roller from the temporary position in the rotational direction in a second start-and-stop motion segment of the motion cycle away from the temporary position to the home position so as to allow the curved surface to drive the entered mailpiece into the second end of the stack.

Preferably, the method further comprises the steps of:

sensing the arrival of said each mailpiece at a reference point in the stacking deck; and determining the driving speed of the mailpiece input device so as to control the motion cycle based on the arrival of said each mailpiece at the reference point and the driving speed of the mailpiece input device when said each mailpiece is released into the stacking deck.

Preferably, the second start-and-stop motion segment is started when the entered mailpiece has been displaced by a pre-determined distance from the reference point, and the method further comprises the step of determining when the entered mailpiece has been displaced by the pre-determined distance based on the arrival of said each mailpiece at the reference point and the driving speed of the mailpiece input device when said each mailpiece is released into the stacking deck.

The present invention will become apparent upon reading the description taken in conjunction with FIGS. 4*a* to 8.

BEST MODE TO CARRY OUT THE INVENTION

Figure 1:
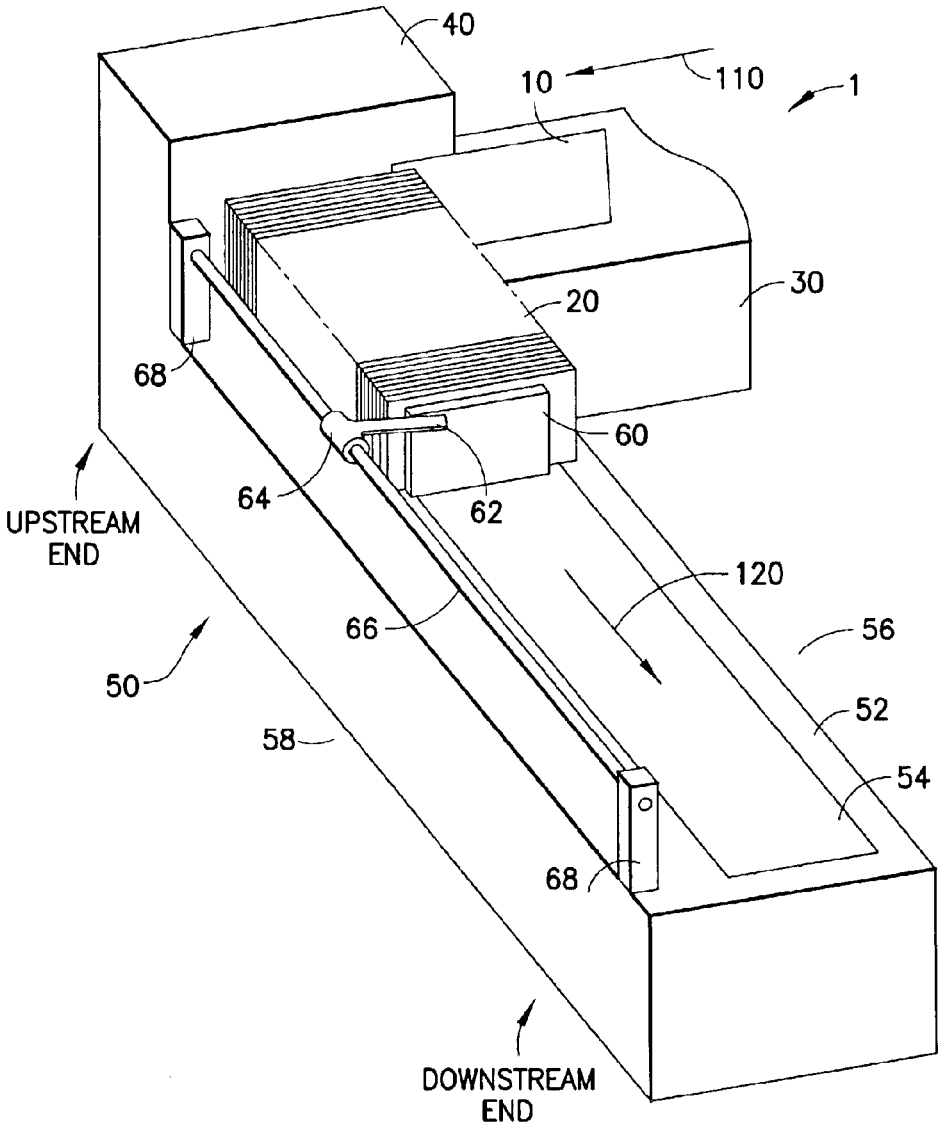
FIG. 1 is a schematic representation illustrating a typical on-edge stacking machine.

In the prior art mailpiece moving device 40, as described in conjunction with FIGS. 3*a*–3*d*, the segmented roller 42 has a one-part motion profile. This means that the segmented roller 42 has only one stationary position within a motion cycle. That stationary position is referred to as the home position. In contrast, the incoming mailpiece moving device 40, according to the present invention, has a two-part motion profile. This means that the segmented roller 42 has two stationary positions and there are two start-and-stop motion segments within a motion cycle. The first stationary position is referred to as the home position. In the first start-and-stop motion segment of the motion cycle, the segmented roller 42 is rotated along the counter-clockwise direction 150 from its home position to the second stationary position such that the planar surface segment 142 is generally perpendicular to the registration wall 48. As such, a momentary gap or channel 242' having two open ends (see FIGS. 4*b* and 4*c*) is formed between the planar surface segment 142 and the bottom end 24 of the mail stack 20 so as to allow an incoming mailpiece 10 to move past the segmented roller 42 without losing momentum.

Figure 2:
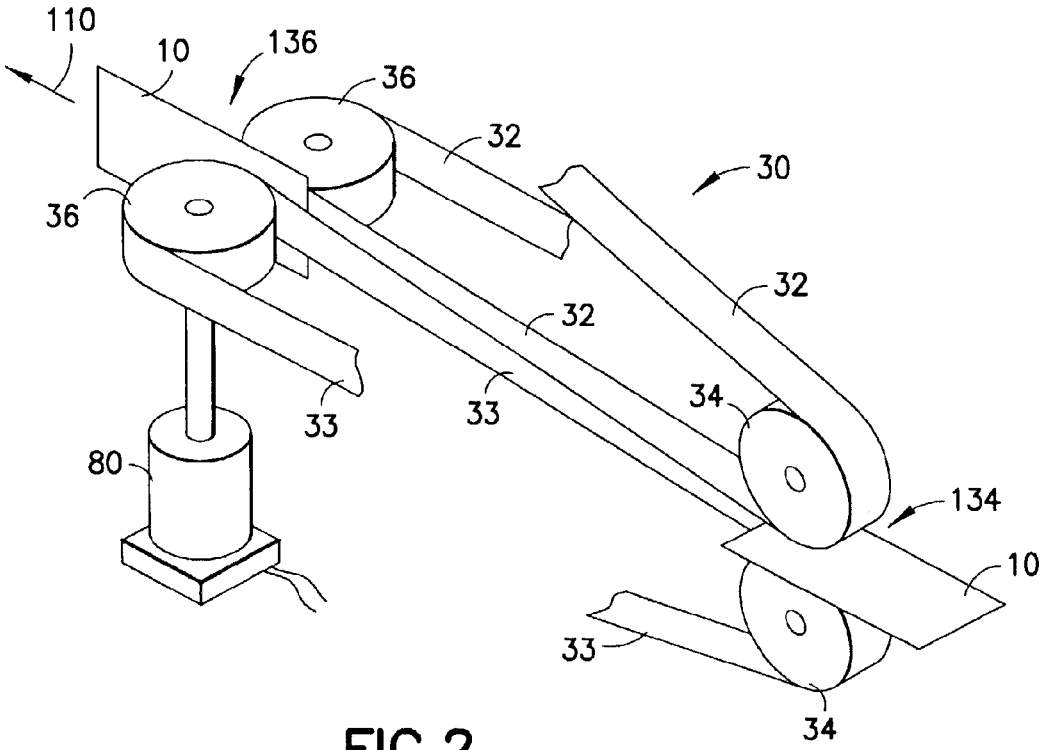
FIG.2 PRIOR ART
FIG. 2 is a schematic representation illustrating a belt turn-up mechanism for changing the orientation of an incoming mailpiece.
Figure 3A:
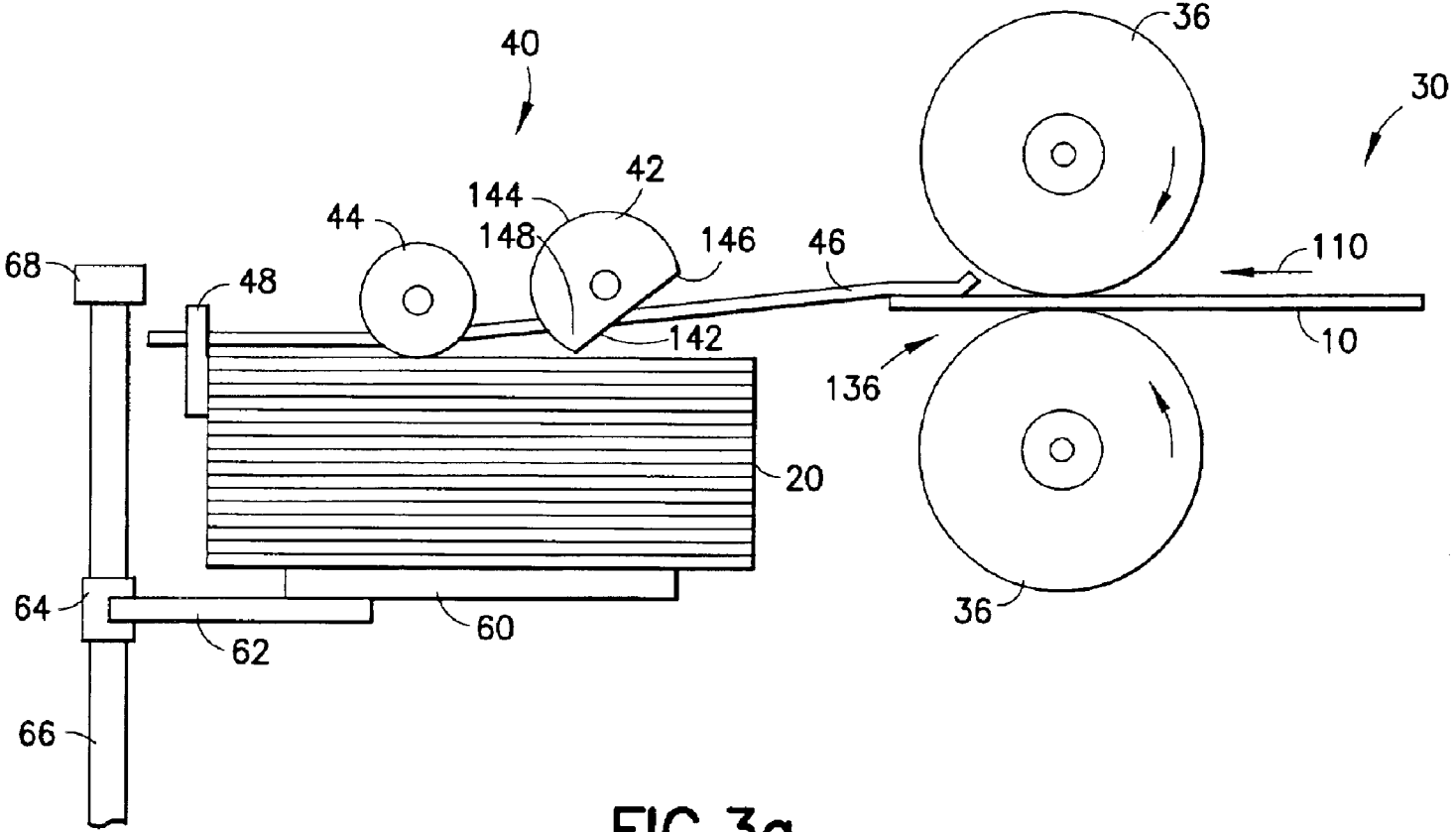
FIG. 3a PRIOR ART
FIG. 3*a* is a schematic representation illustrating the home position of a segmented roller in a prior art mailpiece moving device.
Figure 3B:
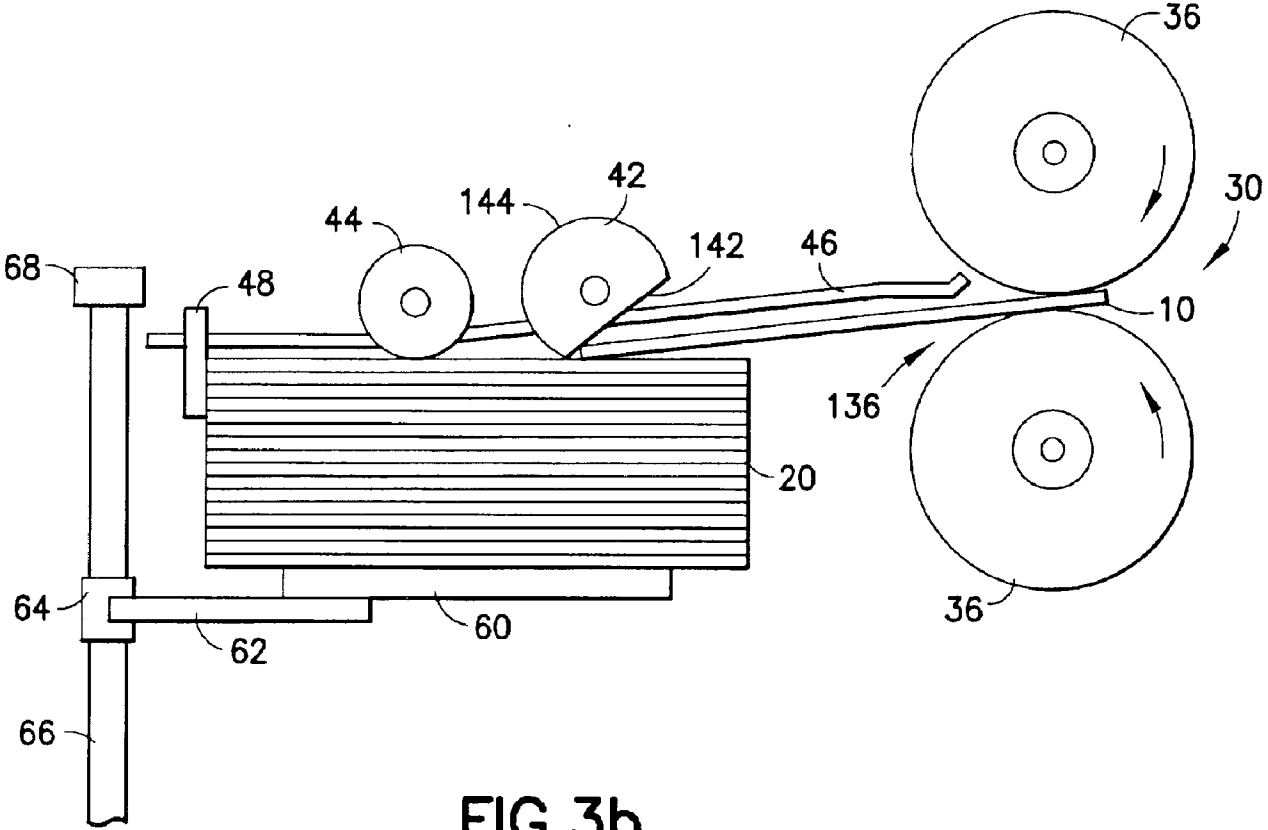
FIG.3b PRIOR ART
FIG. 3*b* is a schematic representation illustrating the starting moment of the motion cycle in the prior art mailpiece moving device.
Figure 3C:
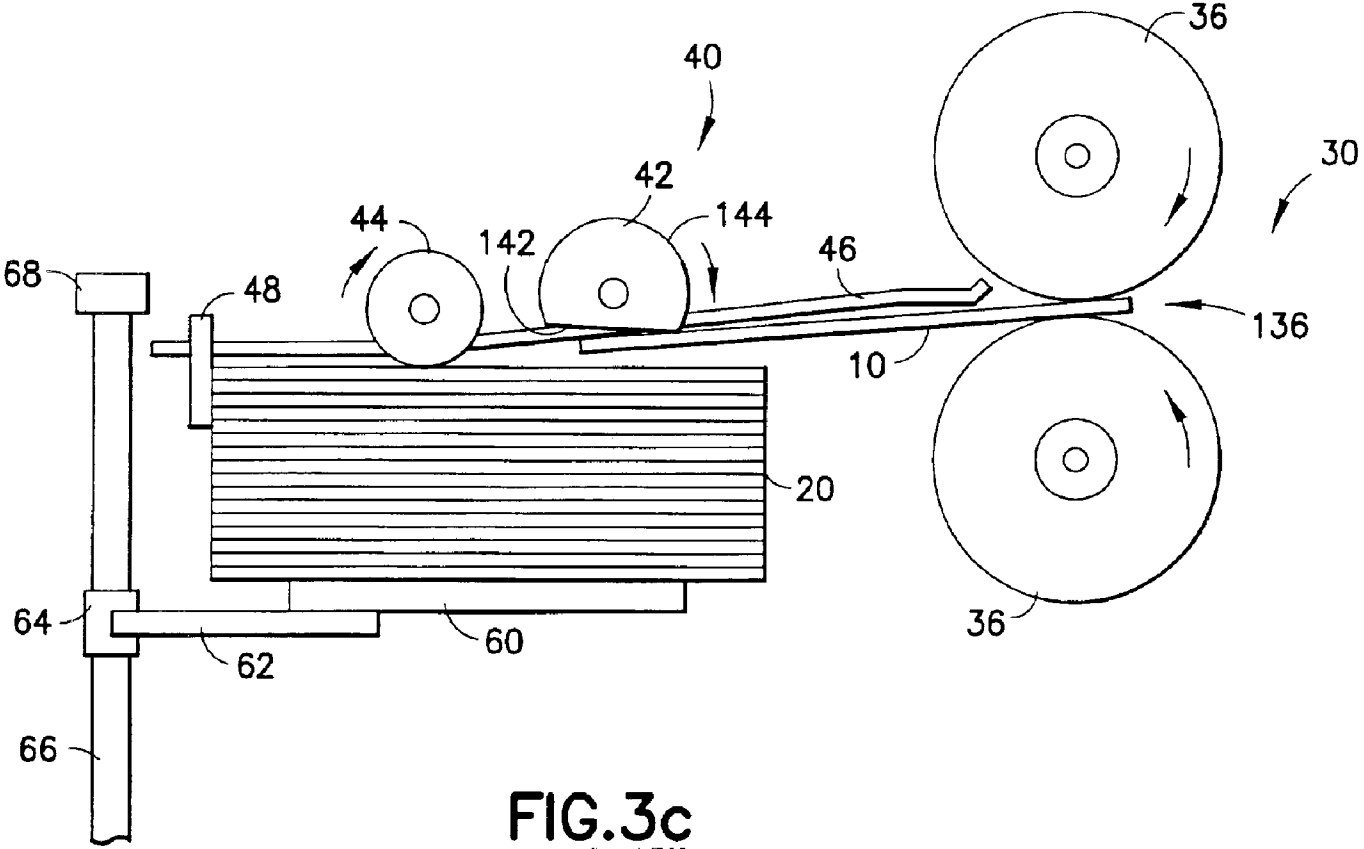
FIG. 3c PRIOR ART
FIG. 3*c* is a schematic representation illustrating a position of the rotating segmented roller in the prior art mailpiece moving device.
Figure 3D:
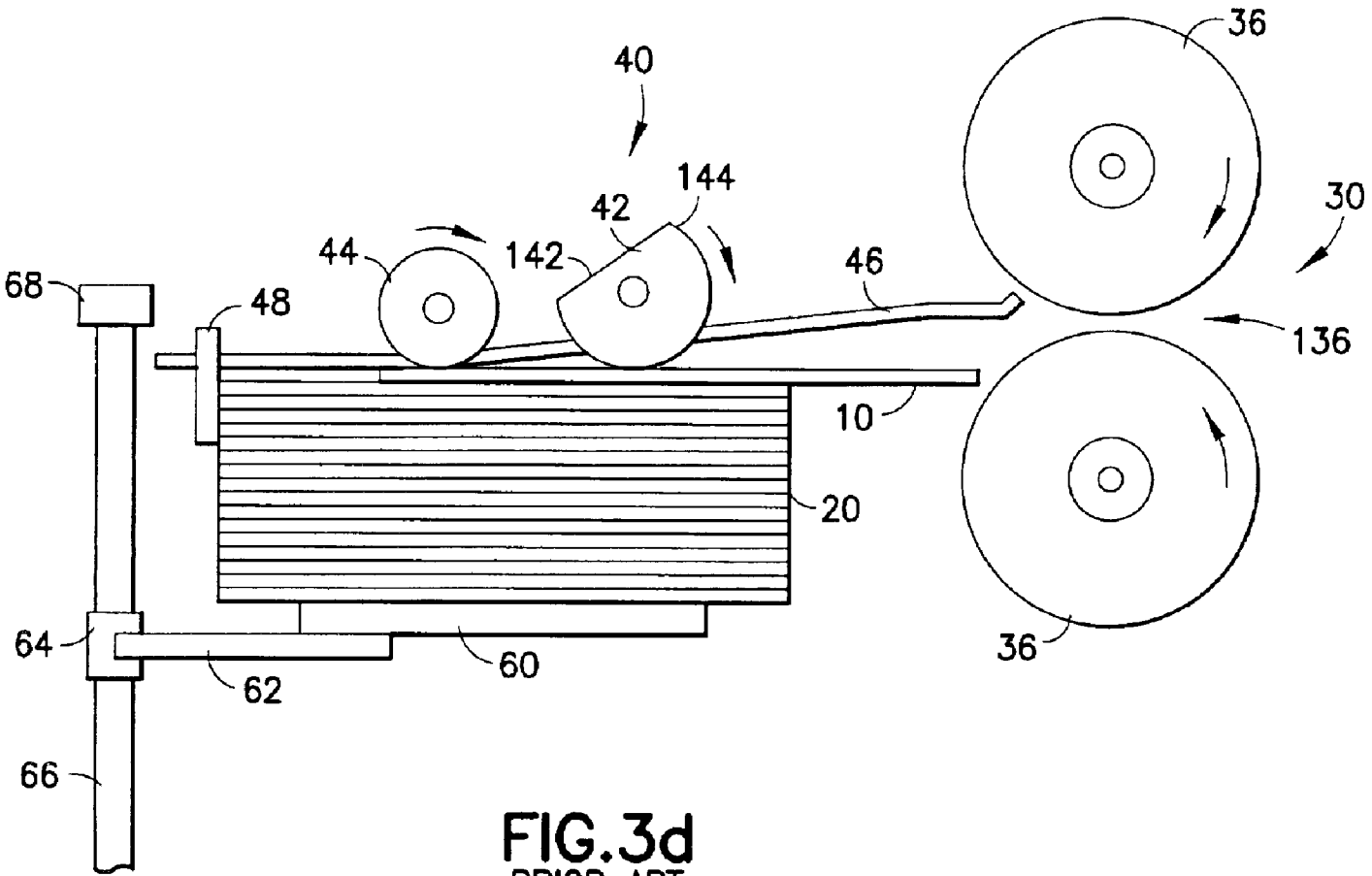
FIG. 3d PRIOR ART
FIG. 3*d* is a schematic representation illustrating a further position of the rotating segmented roller in the prior art mailpiece moving device.
Figure 4A:
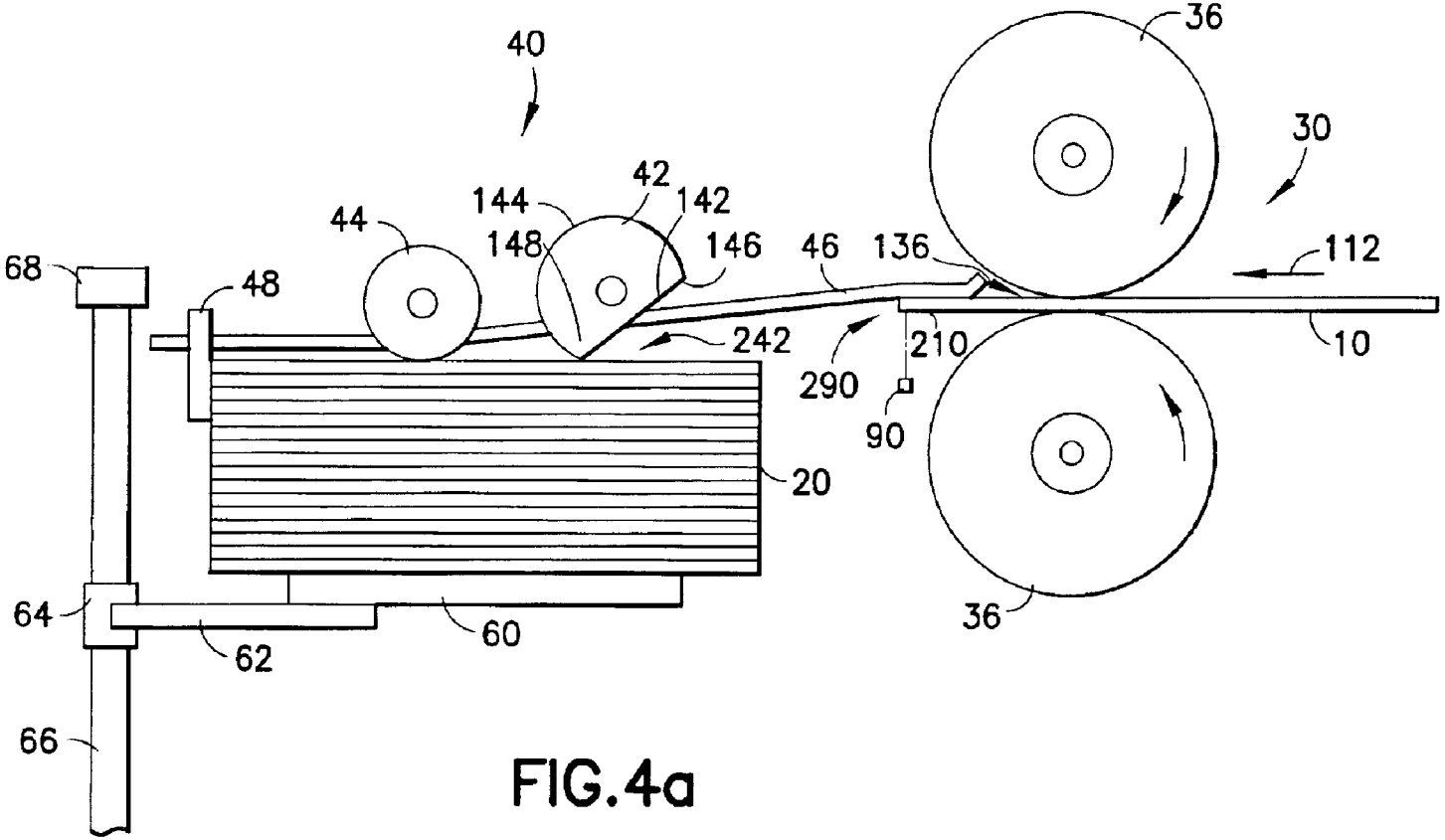
FIG. 4*a* is a schematic representation illustrating the first stationary position of a segmented roller in the mailpiece moving device, according to the present invention.
Figure 4B:
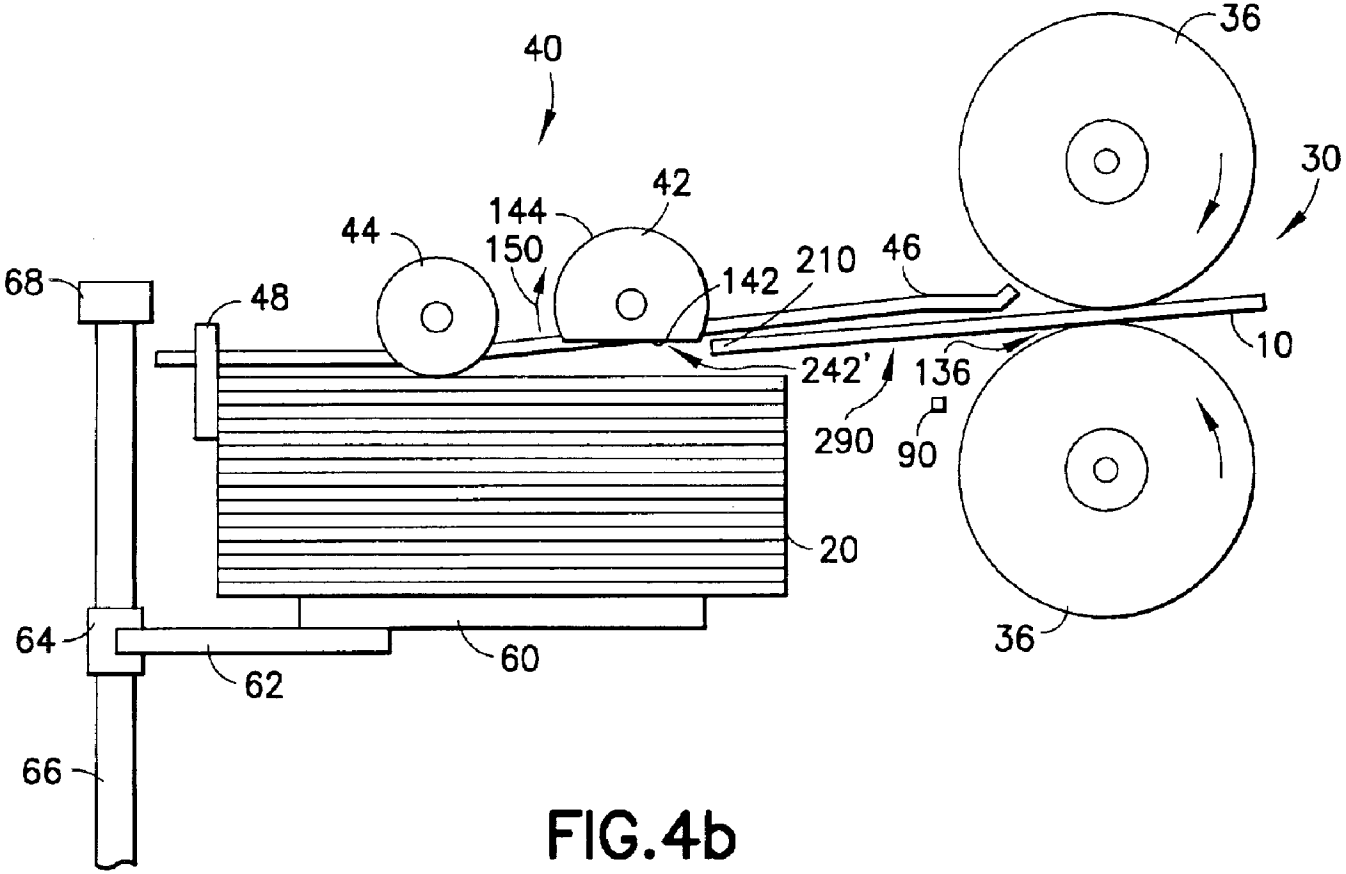
FIG. 4*b* is a schematic representation illustrating a second stationary position of the segmented roller in the mailpiece moving device, according to the present invention.

Furthermore, a sensing device 90 is used to monitor the arrival of the incoming mailpiece 10. As shown in FIG. 4*a*, the sensing device 90 is disposed near the exit nip 136 formed by the exit rollers 36 of the mailpiece input device 30 in order to sense the arrival of the leading edge 210 of the incoming mailpiece 10. The sensing device 90 can be a photosensor, for example. The sensing device 90, along with the moving speed 112 of the incoming mailpiece 10, is used to coordinate the movement of the segmented roller 42. The moving speed 112 of the mailpiece 10 can be obtained based on the rotational speed of the motor 80 (see FIG. 2). Based on the moving speed 112 of the incoming mailpiece 10, it is possible to compute the displacement of the incoming mailpiece 10 relative to a reference point 290 as a function of time. When the mailpiece 10 is displaced from the reference point 290 by a predetermined distance, the segmented roller 42 is cause to rotate in a clockwise direction from its home position to a second position, as shown in FIG. 4*b*.

It should be noted that when the segmented roller 42 is in its home position, as shown in FIG. 4*a*, the inner edge 148 of the segmented roller 42 pushes the bottom of the mail stack 20 toward the upstream end, making room for the incoming mailpiece 10 to enter into the stacking deck 50 from the first side 56. The planar surface 142 of the segmented roller 42 and part of the mail stack bottom 24 form a throat, or wedge-shaped gap 242. If the segmented roller 42 remains at this home position for too long, the incoming mailpiece 10 may be trapped within the throat. The mailpiece 10 may lose its momentum. The second position of the segmented roller 42 prevents the incoming mailpiece 10 from being trapped between the planar surface segment 142 and the bottom of the mail stack 20.

When the segmented roller 42 is rotated in the clockwise direction 150 toward the second stationary position, both the inner edge 148 and the outer edge 146 of the segmented roller 42 are disengaged with from the mail stack 20. Thus, the gap or channel 242' between the planar surface segment 142 and the mail stack bottom 24 has two open ends, as shown in FIG. 4*b*, allowing the mailpiece 10 to pass through. It should be noted that as the planar surface segment 142 is moved away from the mail stack 20, some of the mailpieces at the bottom of the mail stack 20 may move backward because of the stack pressure. Consequently, the gap or channel 242' is reduced. It is essential that the mailpiece 10 has sufficient time to pass through the gap 242' before the gap 242' is substantially narrowed. Thus, the segmented roller 42 is caused to move to its second stationary position only after the incoming mailpiece 10 has arrived at or is very close to the throat 242 formed by the planar surface 142 and the bottom of the mail stack 20 (FIG. 4*a*).

Figure 4C:
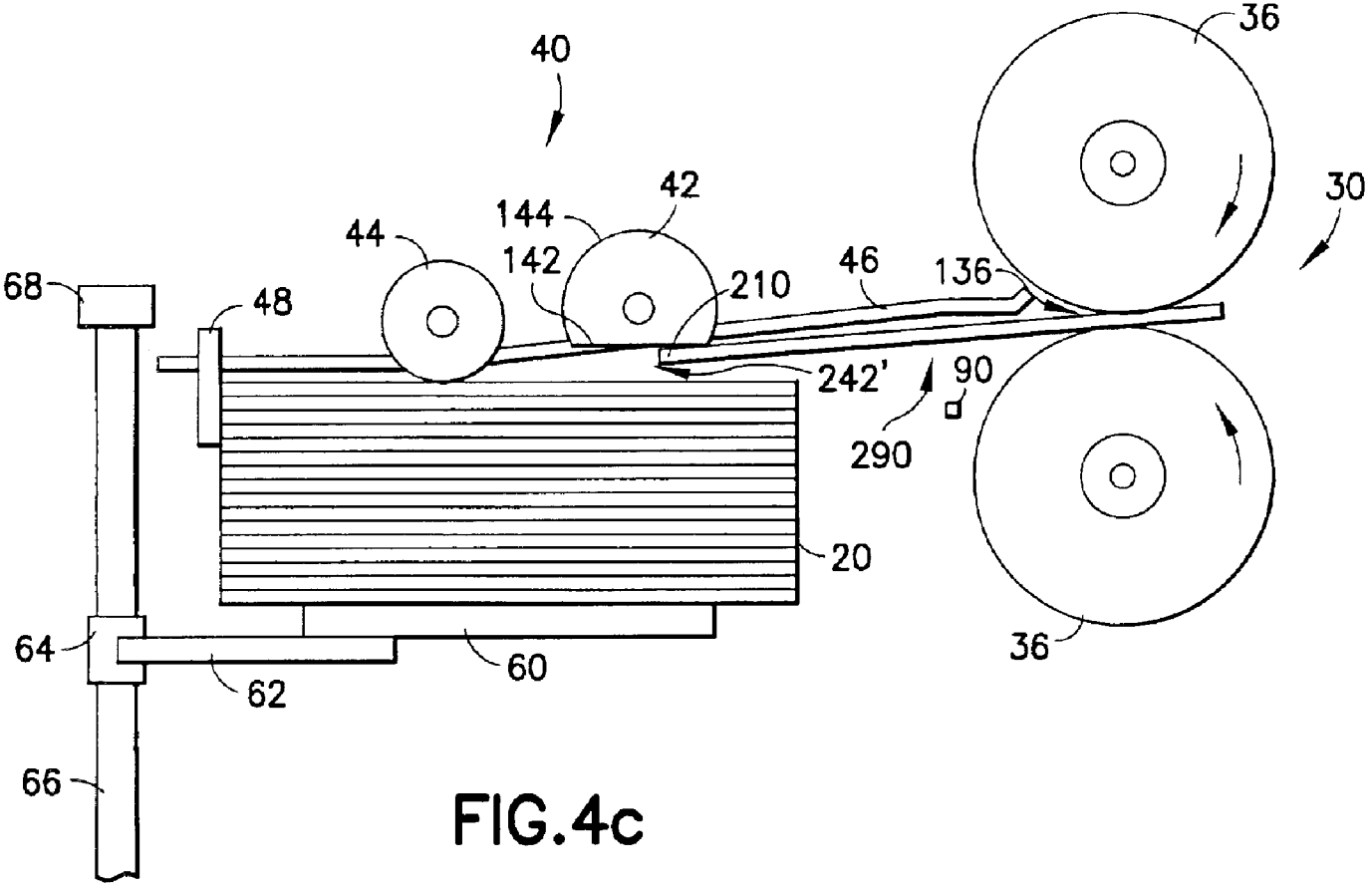
FIG. 4*c* is a schematic representation illustrating the incoming mailpiece entering the gap between the planar surface of the segmented roller and the mail stack, according to the present invention.
Figure 4D:
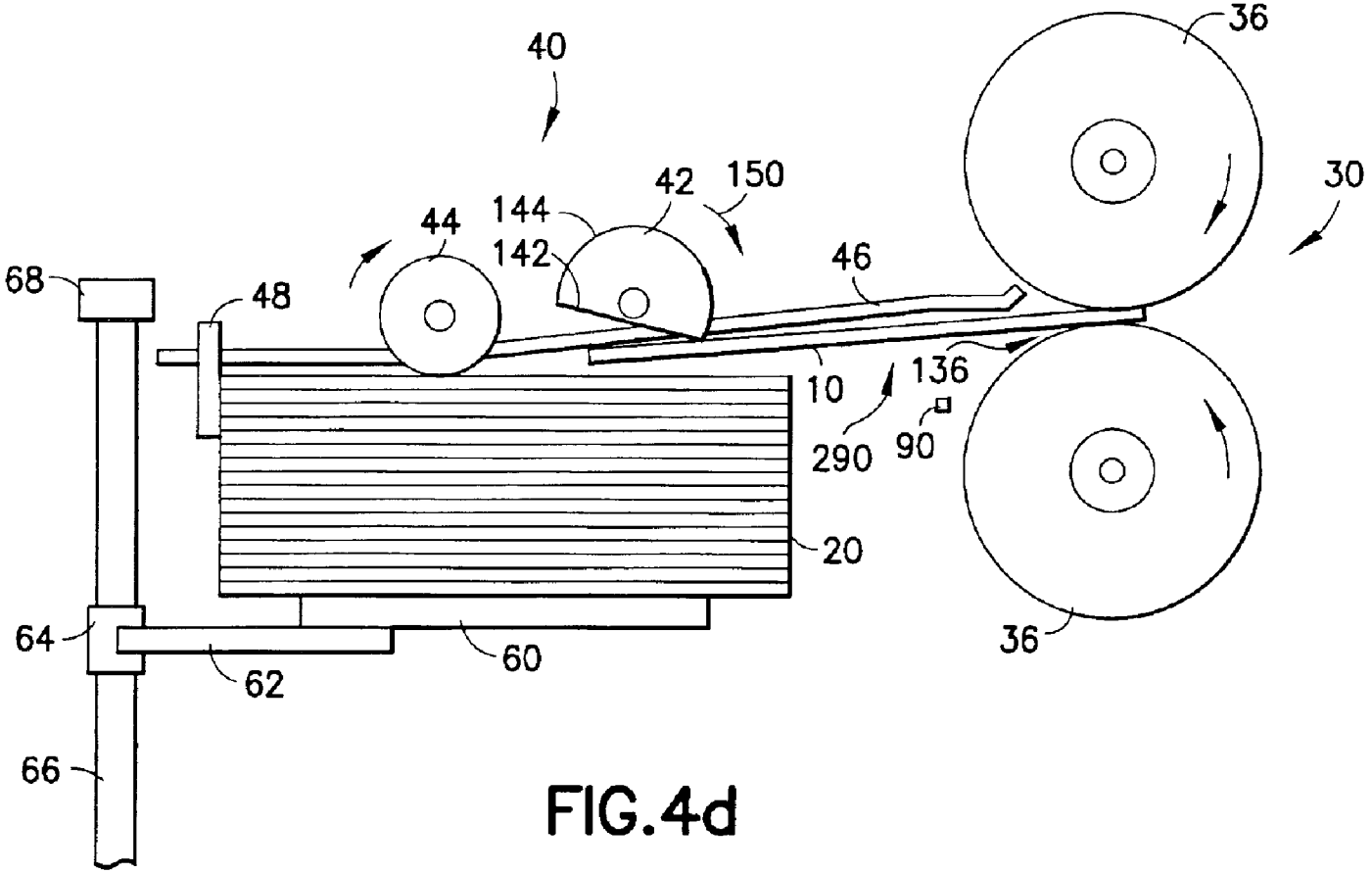
FIG. 4*d* is a schematic representation illustrating a position of the rotating segmented roller in the mailpiece moving device, according to the present invention.

As the gap 242' has two open ends, the leading edge 210 of the incoming mailpiece 10 can pass through the gap 242' unhindered if so allowed, as shown in FIG. 4*c*. When the displacement of the mailpiece 10 reaches a further distance from the reference point 290, the segmented roller 42 is again rotated in a clockwise direction 150 so as to allow the cylindrical surface 144 to drive the mailpiece 10 toward the intake roller 44, as shown in FIG. 4*d*.

Figure 4E:
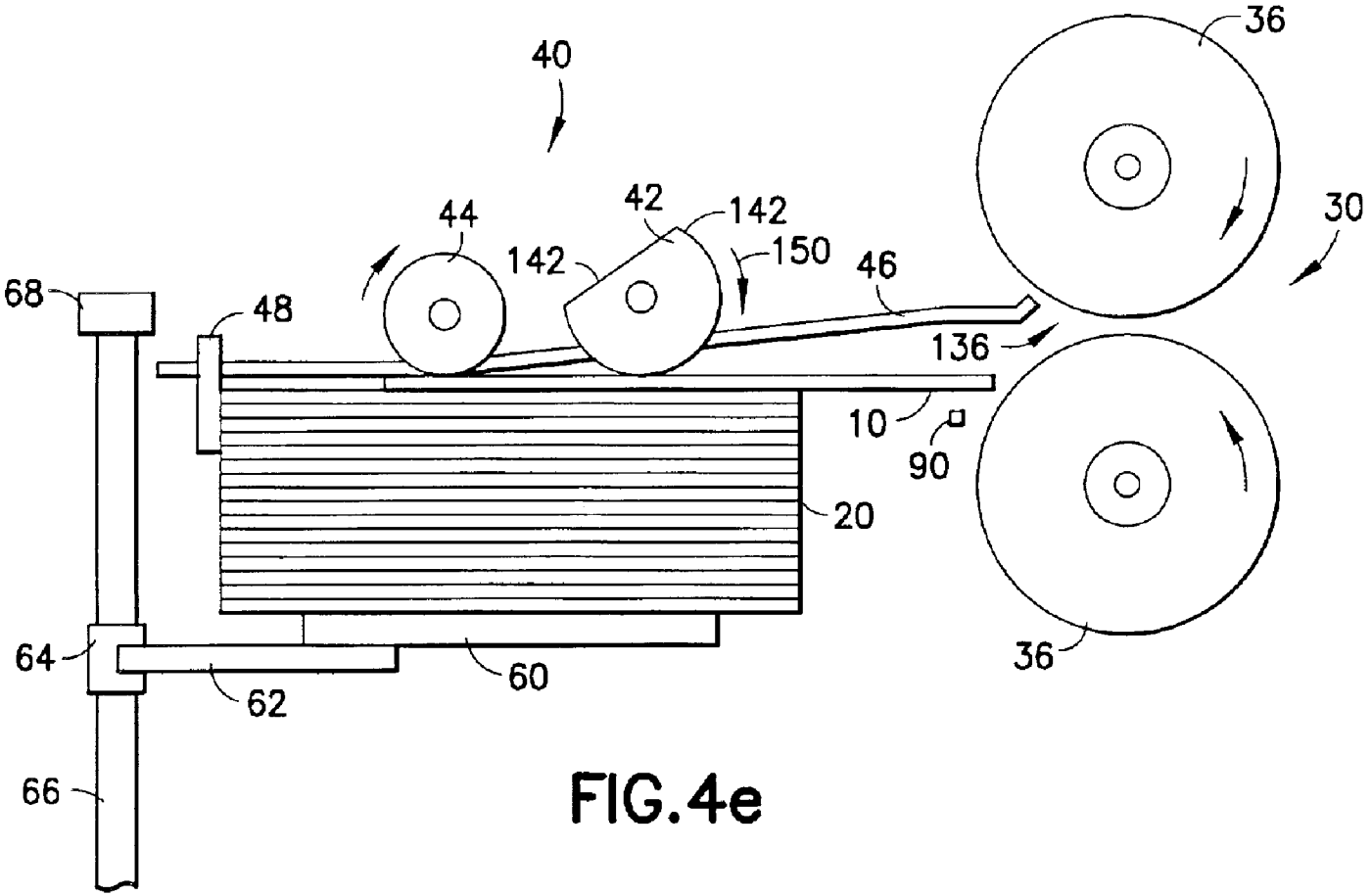
FIG. 4*e* is a schematic representation illustrating a further position of the rotating segmented roller in the mailpiece moving device, according to the present invention.

Together with the intake roller 44, the cylindrical surface segment 144 of the segmented roller 42 drives the mailpiece 10 toward the registration wall 48, as shown in FIG. 4*e*. The segmented roller 42 continues to rotate until it reaches its home position, as shown in FIG. 4*a*, to complete its motion cycle.

Figure 5A:
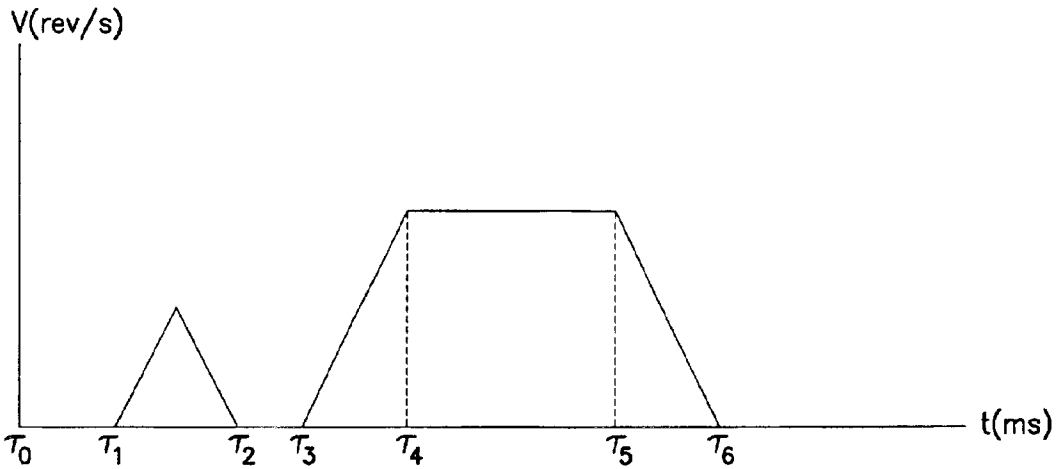
FIG. 5*a* is typical motor speed profile of the two-part motion of the segmented roller, according to the present invention.
Figure 5B:
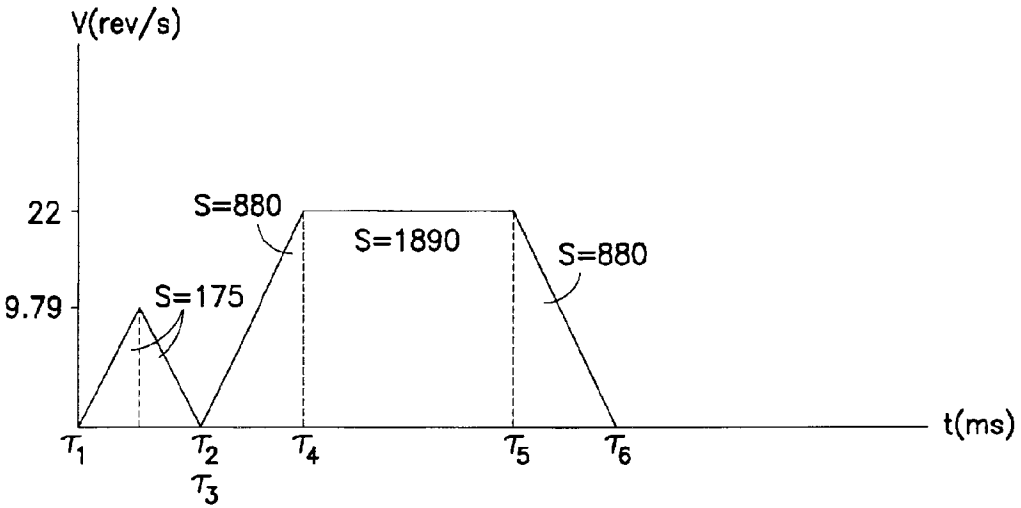
FIG. 5*b* is a preferred motor speed profile of the two-part motion of the segmented roller, according to the present invention

According to the present invention, the motion cycle of the segmented roller 42 has two start-and-stop motion segments, as shown in FIGS. 5*a* and 5*b*. In the first motion segment of the motion cycle, the segmented roller 42 is rotated from its home position to the second stationary position after the incoming mailpiece 10 has been displaced by a first predetermined distance from the reference point 290. In the second motion segment of the motion cycle, the segmented roller 42 is rotated from its second stationary position to the home position after the incoming mailpiece 10 has been displaced by a second predetermined distance from the reference point 290 into the stacking area.

A typical motion profile of the segmented roller 42 is shown in FIG. 5*a*. In FIG. 5*a*, $T_0$ indicates the sensing of the leading edge 210 of the incoming mailpiece 10 by the sensing device 90, and $T_1$ is the time to start the first part of the motion cycle. The duration between $T_0$ and $T_1$ is the time allowed for the mailpiece 10 to be displaced by a predetermined distance from the reference point 290. After the segmented roller 42 is accelerated to move away from its home position in the first part of the motion profile, it is decelerated until it becomes stationary at the second position at $T_2$. The duration between $T_0$ and $T_3$ is the time allowed for the mailpiece 10 to be displaced by a further distance from the reference point 290. By then, it is definitely certain that the mailpiece 10 can be driven by the cylindrical surface segment 144 of the segmented roller 42. Thus, the segmented roller 42 is accelerated to move away from the second position until it reaches a certain speed at $T_4$. From $T_4$ to $T_5$, the segmented roller 42 is rotated in a constant speed. The segmented roller 42 is decelerated at $T_5$ until reaching the home position at $T_6$. Preferably, the motion profile of the segmented roller 42 from $T_1$ to $T_6$ is without a gap between $T_2$ to $T_3$, as shown in FIG. 5*b*. The segmented roller 42 is driven by a motor 70 (see FIG. 7).

The motion profile, as shown in FIG. 5*b*, is calculated based on the following parameters:

Resolution of driven motor 70: 2000 steps per revolution

Motor acceleration and deceleration rate: 500 rev/s$^2$

First part of profile: 350 steps

Second part of profile: 3650 steps

Diameter of the cylindrical surface segment 144:. 2.805 inches

Number of motor revolutions to complete a motion cycle: 2

Maximum speed of motor: 22 rev/s

Accordingly, in the first part of the motion profile, we have:

$$a=(550\ \text{rev}/s^2)(2000\ \text{steps/rev})=1{,}100{,}000\ \text{steps}/s^2$$

$$t=\text{sqrt}(2s/a)=\text{sqrt}(2\times175/1{,}100{,}000)=0.178s$$

$$v=at=(1{,}100{,}000\times0.178)/(2000\ \text{steps/rev})=9.79\ \text{rev}/s$$

where a is the acceleration rate of the motor 70 in steps; t is the time required to complete the 175 steps in half of the first part of the motion cycle; v is speed of the motor 70 when it reaches the half point in the first part of the motion cycle; and ($T_1$ to $T_2$)=2t.

In the second part of the motion profile, we have $$t=v/a=22/550=0.040s$$

$$s=at^2/2=1{,}100{,}000\times(0.040)^2/2=880\ \text{steps}$$

$$t'=[3650-2(880)]/44{,}000=0.043s$$

where t is the time required for the motor 70 to reach its maximum speed from its stationary position; s is the number of steps the motor 70 completes in the time duration t; and t' is the time required for the motor to complete 1890 steps at maximum speed.

Figure 6:
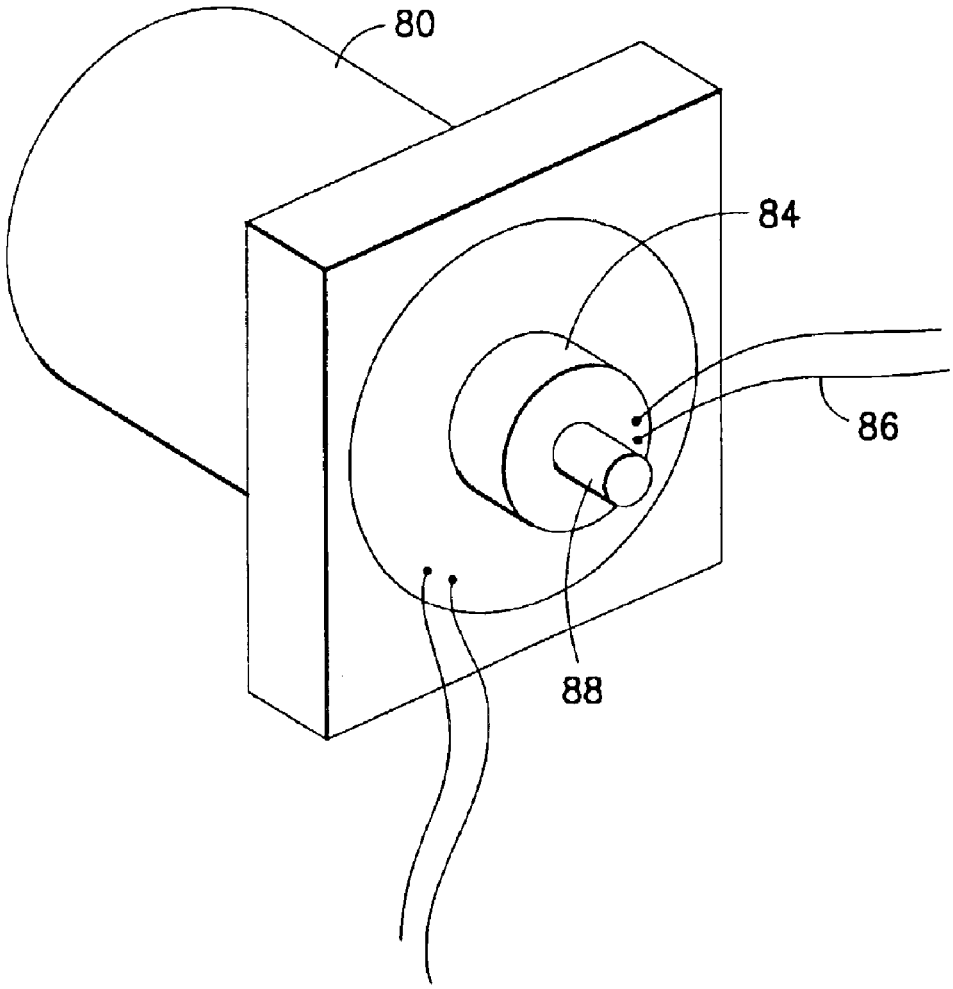
FIG. 6 is a schematic representation illustrating a measurement device attached to a motor to measure the speed thereof, according to the present invention.

In order to coordinate between the movement of the segmented roller 42 and the position of the incoming mailpiece 10 relative to the segmented roller 42, it is preferred that a measurement device be used to measure the speed of the motor 80 at all times so that the displacement of the mailpiece 10 from the reference point 290 can be computed. Advantageously, an optical encoder 84 is mounted on the rear shaft 88 of the motor 80 for such measurements, as shown in FIG. 6. As shown, the cables 86 connected to the encoder 84 are used to supply the power to the encoder 84 and to convey the encoder signal 184 from the encoder 84 to a signal processor 92 for speed measurement, as shown in FIG. 7.

Figure 7:
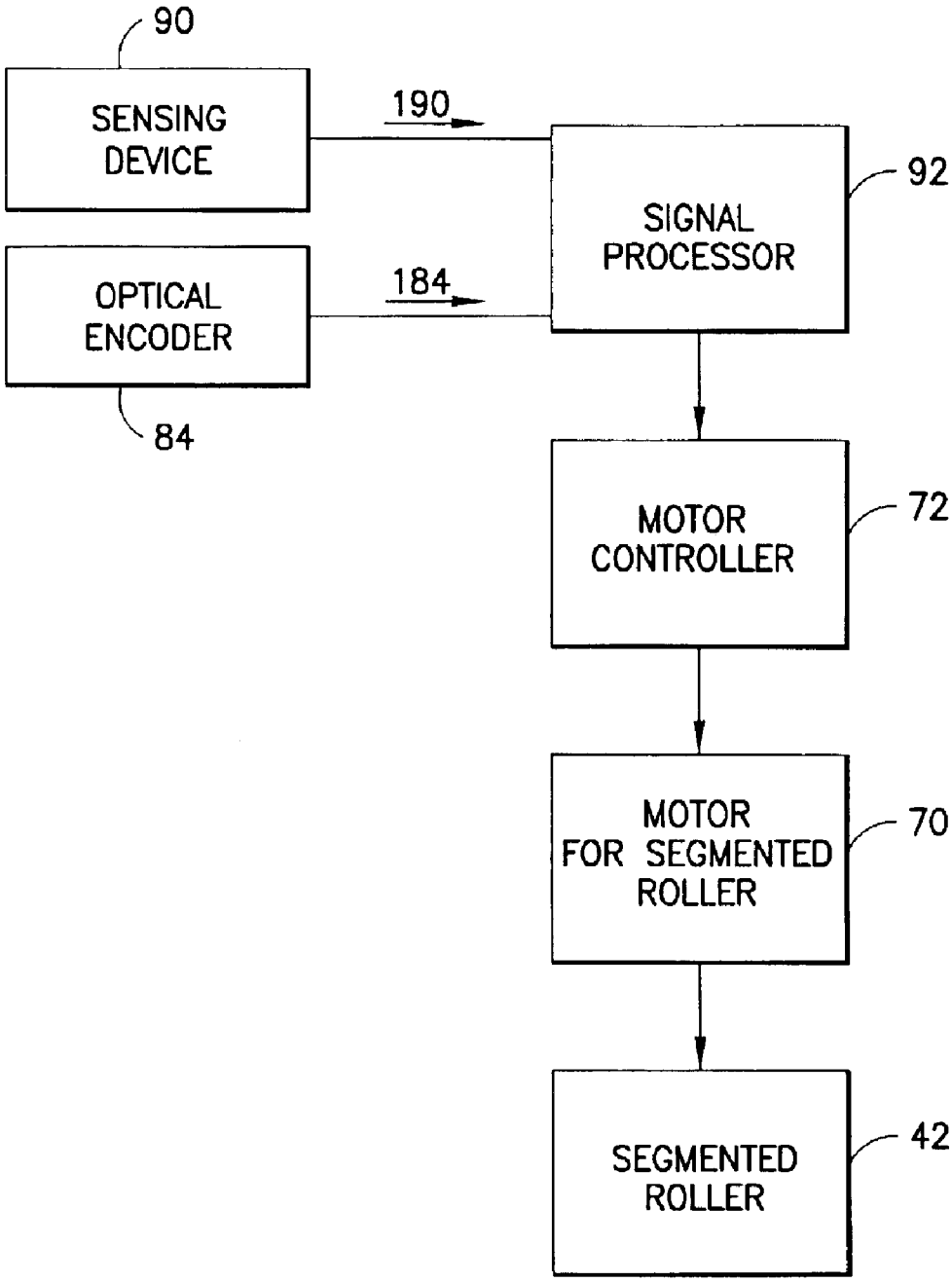
FIG. 7 is a block diagram showing the controlling elements of the segmented roller, according to the present invention.

As shown in the block diagram of FIG. 7, the optical encoder 84 is operatively connected to the signal processor 92 for motor speed measurement. Based on the speed of the motor 80, it is possible to obtain the moving speed of the incoming mailpiece 10. The signal processor 92 is also connected to the sensing device 90 so as to allow a signal 190 indicative of the arrival of the leading edge 210 of the incoming mailpiece 10 to be conveyed to the signal processor 92. Based on the arrival of the leading edge 210 and the moving speed of the incoming mailpiece 10, it is possible to calculate the time t=($T_1$−$T_0$), required for the mailpiece 10 to be displaced by the predetermined distance in order to start the motion cycle. As shown in FIG. 7, the signal processor 92 is operatively connected to a motor controller 72, which controls a segmented roller driving mechanism or motor 70 in order to move the segmented roller 42. Through signal 192, the signal processor 92 provides the timing sequence $T_1$ to $T_5$ to the motor controller 72.

Figure 8:
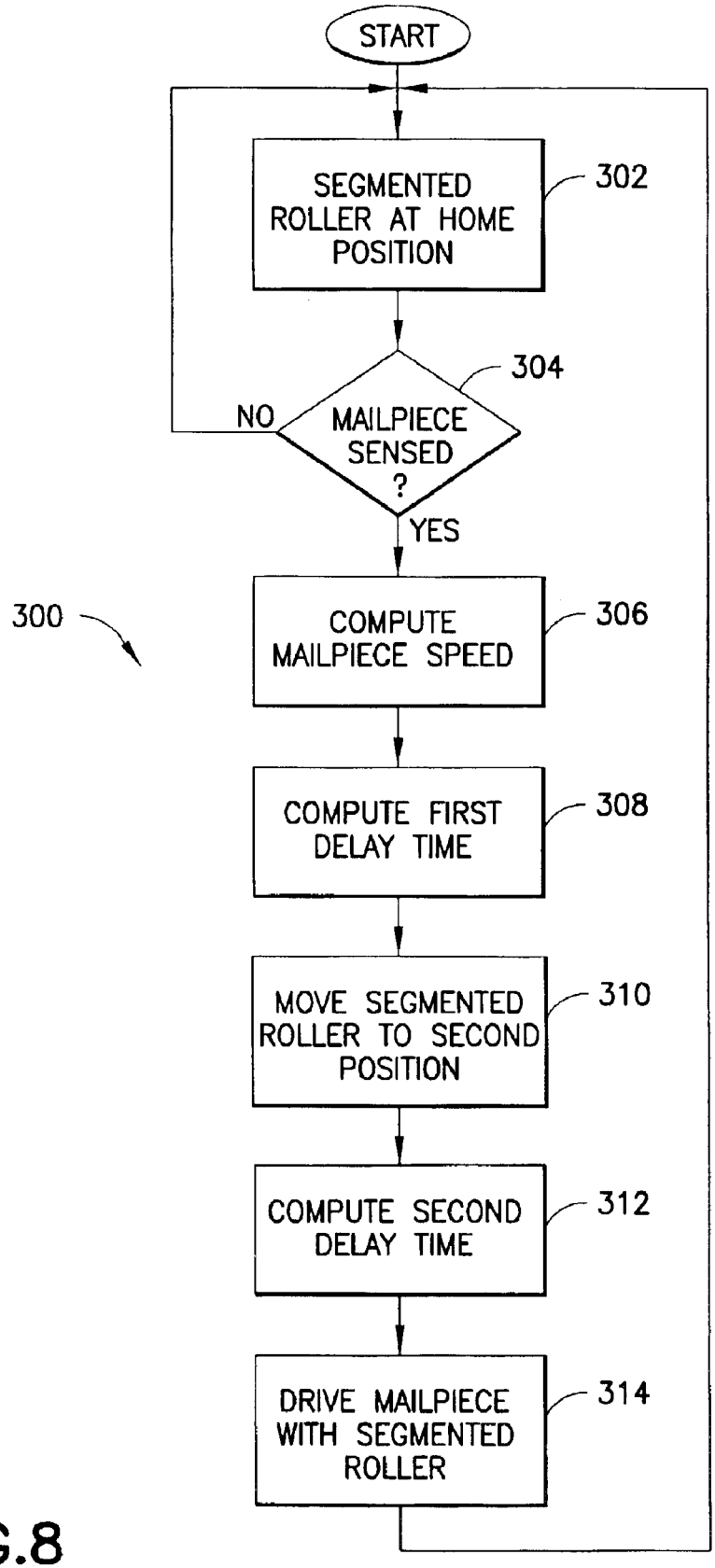
FIG. 8 is a flowchart illustrating the method of motion control, according to the present invention.

The method of controlling the motion cycle of the segmented roller 42, according to the present invention, is summarized in the flowchart 300, as shown in FIG. 8. At start, the segmented roller 42 is stationary at its home position, as indicated at step 302. At step 304, the signal processor 92 waits for the arrival of an incoming mailpiece 10. At step 306, the signal processor 92 computes the moving speed of the mailpiece 10 based on the information provided by the encoder 84 via signal 184. Based on the moving speed of the mailpiece 10 and the desirable displacement distance of the mailpiece 10, the signal processor 92 computes the first delay time ($T_1$−$T_0$) at step 308. At the end of the first delay, the signal processor 92 signals the motor controller 72 to start the first part of the motion cycle at step 310. Based on the moving speed of the mailpiece 10 at the moment and the position of the mailpiece 10 relative to the segmented roller 42, the signal processor 92, at step 312, computes the second delay time ($T_3$−$T_2$) between the first part of the motion cycle and the second part of the motion cycle. At the end of the second delay, the signal processor 92 signals the motor controller 72 to start the second part of the motion cycle at step 314. The control process for the segmented roller 42 is looped back to step 302.

It should be noted that the commencement of the first part of the motion cycle depends on the desirable distance between the leading edge 210 of the mailpiece 10 and the "throat" formed by the segmented roller 42 and the bottom of the mail stack 20 when the segmented roller 42 is at its home position. If the moving speed of the mailpiece 10 is sufficiently high, it is possible to start the first part of the motion cycle while the leading edge 210 is still at a distance from the throat. However, if the moving speed of the mailpiece 10 is sufficiently low, it is preferred that the first part of the motion cycle does not start until the leading edge 210 is already inside the throat. Prematurely starting the first part of the motion cycle may cause the gap 242' to be narrowed or closed by the backward movement of the bottom of the mail stack 20. It is also preferred that the second part of the motion cycle starts only after the leading edge 210 of the mailpiece 10 moves past the gap 242' formed by the segmented roller 42 and the mail stack 20. By doing so, the elastomeric lead edge of the segmented roller 42 "bumps" the trailing half of the mailpiece 10 to assure the mailpiece 10 has sufficient momentum to reach the registration wall 48.

Thus, although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A stacking machine for stacking a plurality of mailpieces into a stack, said stacking machine comprising:

a stacking deck having
an upstream end,
a downstream end,
a first side,
an opposing second side, and
a deck surface to support the stack, the stack having a first end and a second end adjacent to the upstream end;

a mailpiece input device having a driving mechanism for releasing each of the mailpieces at a driving speed into the stacking deck from the first side toward the second side; and a segmented roller having a curved surface section and a cutoff section forming a first edge and a second edge, the first edge adjacent to the first side of the stacking deck and the second edge adjacent to the second side of the stacking deck when the cutoff section is facing the stack, wherein the segmented roller has a home position and is adapted to rotate in a motion cycle in a rotational direction to further move the released mailpiece toward the second side, and wherein when the segmented roller is located in the home position, the second edge is positioned closer than the first edge to the downstream end in order to prevent the mailpieces in the second end of the stack from moving backward toward the upstream end, and each motion cycle comprises a first start-and-stop motion segment and a second start-and-stop motion segment, wherein in the first start-and-stop motion segment, the segmented roller is caused to rotate in the rotational direction from the home position to a temporary position such that the second edge is moved away from the second end of the stack and both the first and second edges are disengaged from the second end of the stack, thereby forming a channel between the cutoff section and the second end of the stack to allow said each mailpiece to enter into the channel, and in the second start-and-stop motion segment, the segmented roller is caused to further rotate in the rotational direction away from the temporary position to the home position so as to allow the curved surface section to drive the entered mailpiece into the second end of the stack.

2. The stacking machine of claim 1, further comprising a sensing device, disposed between the mailpiece input device and the segmented roller, for sensing the arrival of said each mailpiece at a reference point in the stacking deck; and a speed monitoring device for monitoring the driving speed of the mailpiece input device so as to control the motion cycle based on the arrival of said each mailpiece at the reference point and the driving speed of the mailpiece input device when said each mailpiece is released into the stacking deck.

3. The stacking machine of claim 2, wherein the second start-and-stop motion segment is started when the entered mailpiece has been displaced by a pre-determined distance from the reference point, and wherein the arrival of said each mailpiece at the reference point and the driving speed of the mailpiece input device when said each mailpiece is released into the stacking deck are used to determine when the entered mailpiece has been displaced by the pre-determined distance.

4. The stacking machine of claim 3, wherein the speed monitoring device is operatively connected to the driving mechanism of the mailpiece input device for said speed monitoring.

5. The stacking machine of claim 4, wherein the driving mechanism comprises a motor having a shaft, and the speed monitoring device is mounted on the shaft.

6. The stacking machine of claim 5, wherein the speed monitoring device comprises an optical encoder.

7. The stacking machine of claim 2, wherein the start of the first start-and-stop motion segment is based on the arrival of said each mailpiece at the reference point.

8. A method of stacking a plurality of mailpieces into a stack, said stacking machine comprising:

a stacking deck having
an upstream end,
a downstream end,
a first side,
an opposing second side, and
a deck surface to support the stack, the stack having a first end and a second end adjacent to the upstream end;

a mailpiece input device having a driving mechanism for releasing each of the mailpieces at a driving speed into the stacking deck from the first side toward the second side; and a segmented roller having a curved surface section and a cutoff section forming a first edge and a second edge, the first edge adjacent to the first side of the stacking deck and the second edge adjacent to the second side of the stacking deck when the cutoff section is facing the second end of the stack, and wherein the segmented roller has a home position and is adapted to rotate in a motion cycle in a rotational direction to further move the released mailpiece toward the second side, and wherein when the segmented roller is located in the home position, the second edge positioned closer than the first edge to the downstream end in order to prevent the mailpieces in the second end of the stack from moving backward toward the upstream end, said method comprising the steps of:

rotating the segmented roller from the home position to a temporary position in the rotational direction in a first start-and-stop motion segment of the motion cycle such that the second edge is moved away from the second end of the stack and both the first and second edges are disengaged from the second end of the stack, thereby forming a channel between the cutoff section and the second end of the stack to allow said each mailpiece to enter into the channel, and rotating the segmented roller from the temporary position in the rotational direction in a second start-and-stop motion segment of the motion cycle away from the temporary position to the home position so as to allow the curved surface to drive the entered mailpiece into the second end of the stack.

9. The method of claim 8, further comprising the steps of:

sensing the arrival of said each mailpiece at a reference point in the stacking deck; and determining the driving speed of the mailpiece input device so as to control the motion cycle based on the arrival of said each mailpiece at the reference point and the driving speed of the mailpiece input device when said each mailpiece is released into the stacking deck.

10. The method of claim 9, wherein the second start-and-stop motion segment is started when the entered mailpiece has been displaced by a pre-determined distance from the reference point, said method further comprising the step of determining when the entered mailpiece has been displaced by the pre-determined distance based on the arrival of said each mailpiece at the reference point and the driving speed of the mailpiece input device when said each mailpiece is released into the stacking deck.

* * * * *